US008528758B2

(12) United States Patent
Morlot et al.

(10) Patent No.: US 8,528,758 B2
(45) Date of Patent: Sep. 10, 2013

(54) CLOSURE ELEMENT FOR A CONTAINER MADE OF PARTICULARLY SHEET TYPE MATERIAL

(75) Inventors: Séverine Morlot, Annet sur Marne (FR); Frédéric Berthelin, Meaux (FR)

(73) Assignee: Seaquist Closures France, Poincy (FR)

( * ) Notice: Subject to any disclaimer, the term of this patent is extended or adjusted under 35 U.S.C. 154(b) by 10 days.

(21) Appl. No.: 13/002,746

(22) PCT Filed: Jul. 7, 2009

(86) PCT No.: PCT/EP2009/004907

§ 371 (c)(1), (2), (4) Date: Mar. 4, 2011

(87) PCT Pub. No.: WO2010/003637

PCT Pub. Date: Jan. 14, 2010

(65) Prior Publication Data

US 2011/0142376 A1 Jun. 16, 2011

(30) Foreign Application Priority Data

Jul. 8, 2008 (FR) ..... 08 03883

(51) Int. Cl.
*B65D 33/16* (2006.01)

(52) U.S. Cl.
USPC ..... 215/252; 222/92; 383/906

(58) Field of Classification Search
USPC ..... 215/330, 331, 252, 253, 250; 222/92, 222/541.5, 566; 383/906
See application file for complete search history.

(56) References Cited

U.S. PATENT DOCUMENTS

| | | | | |
|---|---|---|---|---|
| 495,299 | A * | 4/1893 | Calcutt | 215/330 |
| 4,480,761 | A * | 11/1984 | Aichinger | 215/252 |
| 5,823,383 | A * | 10/1998 | Hins | 220/601 |
| 5,971,613 | A * | 10/1999 | Bell | 383/107 |

(Continued)

FOREIGN PATENT DOCUMENTS

| | | |
|---|---|---|
| EP | 0 486 408 A | 5/1992 |
| FR | 2 852 295 A | 9/2004 |

OTHER PUBLICATIONS

English language translation of the International Search Report for corresponding PCT Application No. PCT/ EP2009/004907 mailed on Sep. 21, 2009.

*Primary Examiner* — Anthony Stashick
*Assistant Examiner* — Robert Stodola
(74) *Attorney, Agent, or Firm* — Wood, Phillips, Katz, Clark & Mortimer

(57) ABSTRACT

Closure element (1) of a container particularly made from foil-type material, in particular of a bag-type container for receiving a liquid substance, the closure element having a base (5) that can be fixed to or is already fixed to the container, and which defines a passage (13) and a lid member (3) mounted to the base (5) to clear and close the passage (13), characterized in that the closing element (1) has a transport state in which the lid member (3) is attached to the base (5) via at least one predetermined breaking point (61), and an installation state in which, after separation of the predetermined breaking point attachment, the lid member (3) can rotate relative to the base (5) from an open position to a locked position in which the lid member (3) is removably held at the base (5) by a detent mechanism.

14 Claims, 3 Drawing Sheets

(56) References Cited

U.S. PATENT DOCUMENTS

| | | | | |
|---|---|---|---|---|
| 6,000,848 | A * | 12/1999 | Massioui | 383/80 |
| 6,112,949 | A | 9/2000 | Rhodes et al. | |
| 6,164,822 | A * | 12/2000 | Beer | 383/38 |
| 6,439,429 | B1 * | 8/2002 | Gross | 222/92 |
| 6,854,888 | B1 * | 2/2005 | Brown et al. | 383/80 |
| 6,860,406 | B2 * | 3/2005 | Kobetsky et al. | 222/92 |
| 2004/0155045 | A1 | 8/2004 | Wild | |
| 2005/0139565 | A1 | 6/2005 | Cohn | |
| 2007/0012644 | A1 * | 1/2007 | Uytterhaeghe et al. | 215/48 |
| 2007/0194047 | A1 * | 8/2007 | Tauber et al. | 222/109 |

* cited by examiner

CLOSURE ELEMENT FOR A CONTAINER MADE OF PARTICULARLY SHEET TYPE MATERIAL

FIELD OF INVETION

The present invention relates to a container made particularly of sheet type material. In particular the invention relates to a closure element for a bag-type container.

BACKGROUND OF THE INVENTION

The container should be suitable for receiving a liquid or fluent substance like a drink. Usually the closure element has a base attachable to or already attached to the container, in particular integrally attached to it, defining a passage connected to the inside of the container through which the liquid substance can be dispensed from the container. The container can also be filled or refilled through the passage. Furthermore, a known closure element has a lid member installed on the base for clearing and closing the passage. An example of this type of closure element is known from the French Patent Application FR 2885601.

It is necessary, particularly in the case of a container for receiving a drinkable liquid, to design the closure element such that the consumer is always given the impression of having a hygienic mouthpiece in the mouth when the container is to be closed and opened several times, in particular repeatedly successively.

BRIEF SUMMARY OF THE INVENTION

The objective of the invention is to overcome the disadvantages of the prior art, in particular to create a closure element for a container particularly made from sheet-like material, in particular for a bag-type container, which can be used more than once and therefore must be reclosable so that the components of the closure element, that may come into oral contact with the consumer, are hygienically protected.

This objective is achieved by a closure element according to claim 1 for a container particularly made from foil-type material, in particular for a bag-type container for receiving a liquid substance, the closure element having a base that can be fixed to or is already fixed to the container, and which defines a passage and a lid member mounted to the base to clear and close the passage. According to the invention the closing element has a transport position in which the lid member is attached to the base via at least one predetermined breaking point, and an installation or application position or state in which, after separation of the predetermined breaking point attachment, the lid member can rotate relative to the base from a cleared position to a locked position in which the lid member is removably held at the base by a detent mechanism.

The measure according to the invention, consisting in providing a lid member that is held securely at the base by means of predetermined breaking points prior to first usage, that is during transport to the end user, ensures that the base via which, in case of a drinking container, the end user usually orally uses the closure element or via which the liquid medium is poured into a container, is protected from external influences by the lid member. Preferably the lid member surrounds at least for the largest part a dispensing portion or dispensing beak so that a contaminating influence from outside onto the dispensing beak of the base is prevented. The rotatability of the lid member from the cleared position, in which the lid is completely separated from the base and in particular can be withdrawn from the base in order to expose the dispensing beak for usage, into the locked position imposes to the end user a reliable ergonomic movement for opening and closing the container. In the locked position of the lid member the latter is removably but tightly held at the base, and the beak of the base is nearly completely protected from external influences by the lid member. By disengaging the detent mechanism, the lid member can be separated again from the base. The detent mechanism enables in a simple manner to repeatedly disengage the lid member from the base and to fix it at the base again in order to frequently put to the lips and set down the container via the closure element of the invention.

The invention, according to which a lid member that can be held by a detent mechanism at the base part, wherein the lid member is held at the base by means of predetermined breaking points prior to the first usage, enables to provide a closure element that can be opened and closed ergonomically according to usual handling practice, that is by means of a rotational movement, without having to form a complicated internal or external thread at the base or at the lid member, which would be expensive to manufacture.

In a preferred embodiment of the invention the detent mechanism is formed by at least two hooks, one of which is respectively fixed at the base and at the lid member and which engage with each other in a detent manner in the locked position. Preferably two pairs of hooks are provided that can be disposed at diametrically opposed circumferential positions in case of a basically cylindrical shape of the base and the lid member.

In a further development of the invention the hooks have protrusions facing each other in the locked position and engaging in a recess of the respectively other hook in a snapping manner in the locked position of the lid member.

Preferably the hooks are respectively disposed at the exterior of the base and the lid member. The hooks are essentially oriented in rotational direction of the middle part.

In a further development of the invention a hook at the cover side can cooperate with a bedstop at the base side for determining the axial position of the lid member relative to the base. In this way it is possible to generate in an ergonomically obvious manner a defined axial position of the lid member upon mounting of the lid member, from which axial position the end user can reliably reach the locked position by actuating the detent mechanism. In particular, the hook at the base side can extend from the bedstop towards the lid member.

In a further development of the invention the bedstop is formed with a ramp which is preferably disposed adjacent to the hook at the base side. Therein the ramp shall be disposed relative to the hook at the base side in such a way that upon engagement of the hooks for actuating the detent mechanism, the hook at the cover side is pushed towards the hook at the base side in order to generate snapping forces for holding the lid member in the locked position.

In a preferred embodiment of the invention the bedstop is formed as a large peripheral bearing or circumferential shoulder with a particularly exclusively radial outer side surface that faces the lid member. The shoulder can be integrally formed at the base as a ring-shaped disc member.

In a further development of the invention a portion of the at least one predetermined breaking point is disposed at an inner edge of the lid member, which edge faces the container. Self-evidently the other portion of the predetermined breaking point is provided at an area of the base facing the lid member for forming the connection slot or rib. Preferably the at least one predetermined breaking point is formed by a narrow connection slot designed to fail and break upon transmission of predetermined rotational forces in order to liberate the lid member for a free rotational movement around the base and for a subsequent withdrawal of the lid member from the base. The narrow connection slot extends from an inner side of the lid member towards an outer side of the base.

Preferably more than three or four connection slots are provided, disposed at equal distance from each other.

In particular the said beak or pouring portion of the base can, in a preferred embodiment of the invention, be formed by a wall section defining a cylindrical outer surface for a pleasant oral touch. The wall section of the base serves the purpose to exactly position and/or guide axially and radially the lid member during unmounting and mounting. In particular when the lid member is placed over the external cylindrical wall section and cooperates with the axial bedstop of the base, the wall section serves the purpose to guide the lid member for a defined rotational movement. Therein, the external cylindrical wall section can cooperate with a passage of the lid member, which passage is shaped complimentary to the external cylindrical wall section.

In a preferred embodiment of the invention the lid member has a cylindrical internal passage in which the external cylindrical wall section of the base is placed in the locked position. Therein the lid member is to be disposed relative to the base in such a way that an opening of the orifice of the base leads up to the internal passage of the lid member and thus is protected from external influences when the lid member is mounted at the base.

The lid member is composed preferably of a support intended to protectively surround the pouring beak of the base and its passage orifice, and of a closure cap in particular swivelling or pivotably attached to the support. The closure cap can be brought from an open position to a closed position in which the orifice of the passage of the base is closed by the closure cap.

Preferably the lid member also defines a passage open to the outside that is also closed by the closure cap. Therein, the closure cap can have an arresting mechanism that secures the closure cap in the closed position at the support. The closure cap can have a particularly cylindrical protrusion pointing towards the base from an inner side of the cap, which inner side faces the inside of the container in the locked position, the protrusion having a complimentary shape with respect to the opening of the passage of the base in order to close the latter in a fluid-tight manner.

In a preferred embodiment of the invention the base has a wedge-shaped reinforcement section, in particular with lateral ribs, at which is fixed in particular the beak, preferably the external cylindrical wall section. The wedge-shaped reinforcement section serves the purpose to enable welding the base onto a foil-type container not having an inherently stable structure. Therein the reinforcement section can be surrounded by a part of the bag-type container wherein the pouring beak, in particular the wall section of the base is disposed outside the container.

In a further development of the invention the lid member, the base and the at least one predetermined breaking point are integrally made in one piece, in particular in one plastic piece, particularly injection moulded.

BRIEF DESCRIPTION OF THE DRAWINGS

Further characteristics, advantages and features of the invention will become apparent from the following description of a preferred embodiment of the invention in conjunction with the attached drawings showing.

DETAILED DESCRIPTION OF THE INVENTION

Figure 1:
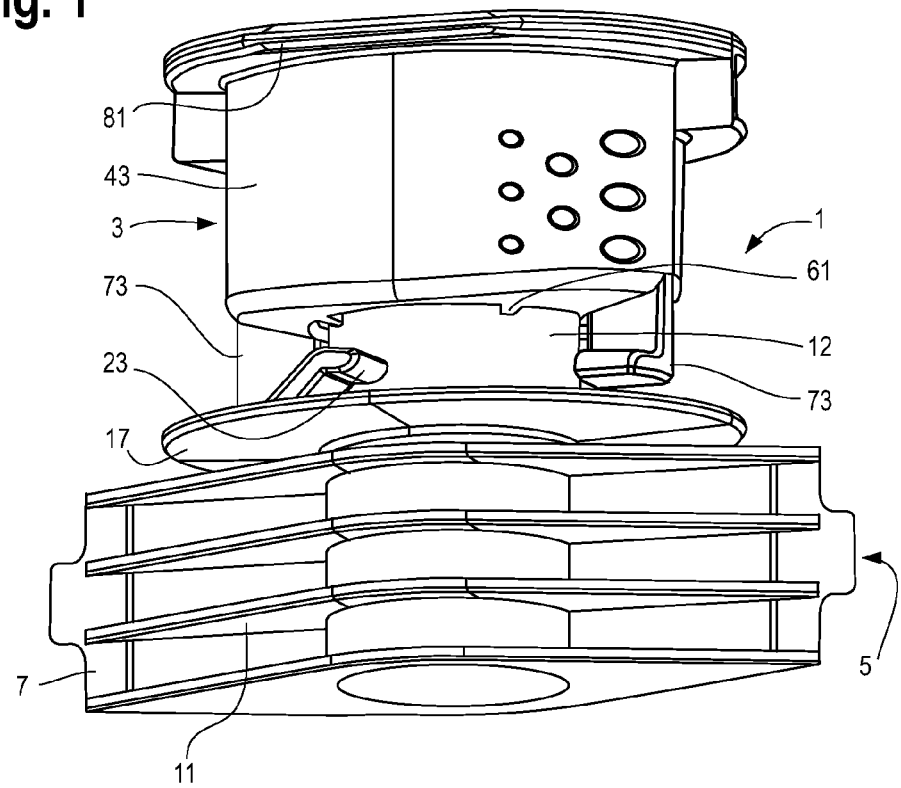
FIG. 1: a perspective view of the closure element according to the invention as seen from the base.
Figure 2:
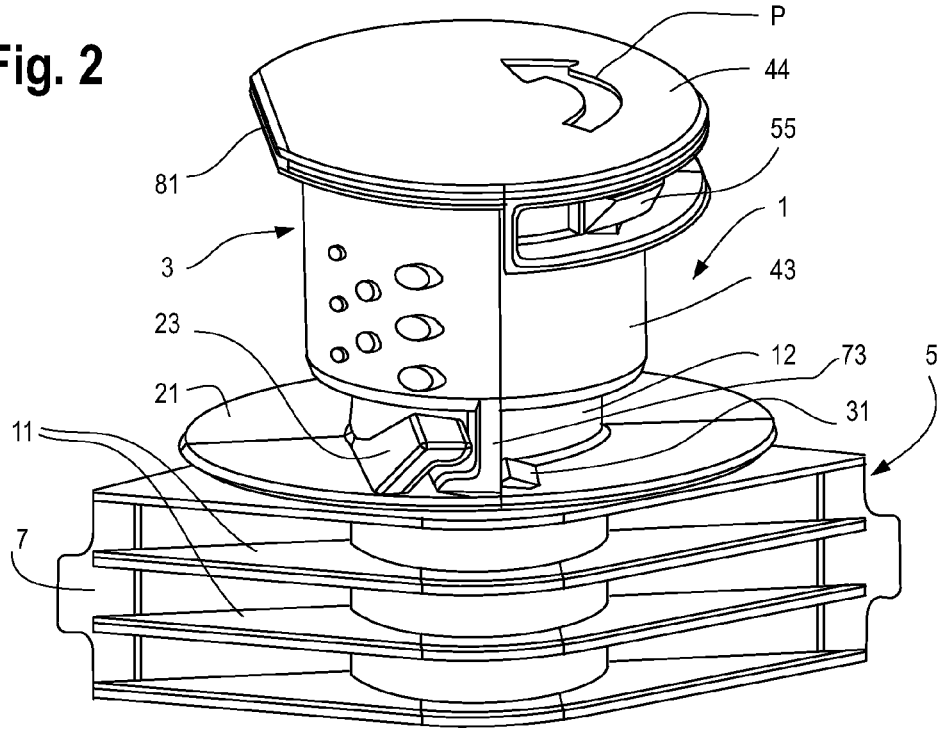
FIG. 2: a perspective view of the closure element according to the invention as in FIG. 1, seen from direction of the lid member.

In FIGS. 1 and 2 the closure element according to the invention for a bag-type container, not represented, is generally given the reference numeral 1.

The closure element 1 is formed by two main components separated from each other, namely a mainly cylindrical lid member 3 and a base 5 that is completely surrounded by the lid member 3 at an end region at the outpour side. The base 5 has a double wedge shaped attachment and/or reinforcement section 7, to which the bag-type container can be welded. For an especially fluid-tight and solid coupling of the bag-type container at the reinforcement section 7, the latter has transversally extending ribs 11.

Furthermore, the base 5 forms at the side facing away from the container a beak or a spout 12 defining at its inside a passage 13 for the liquid present in the container. As represented in FIGS. 1 and 2, the beak 12 nearly completely disappears in the lid member 3. The opening 15 of the passage 13 is disposed within the lid member 3, which is not recognisable from the figures.

Figure 8:
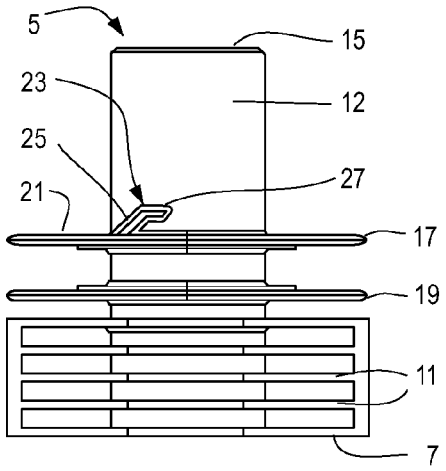
FIG. 8: a side view of a base of the closure elements of the invention as in FIGS. 1 and 2.
Figure 9:
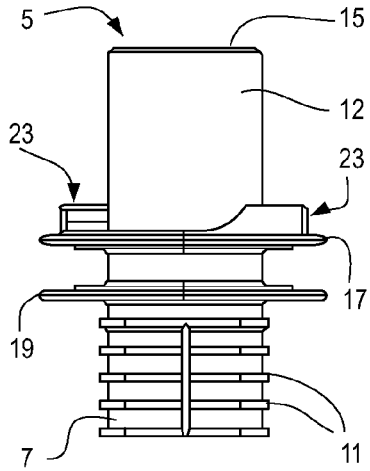
FIG. 9: a side of the base as in FIG. 8, rotated by 90°.
Figure 10:
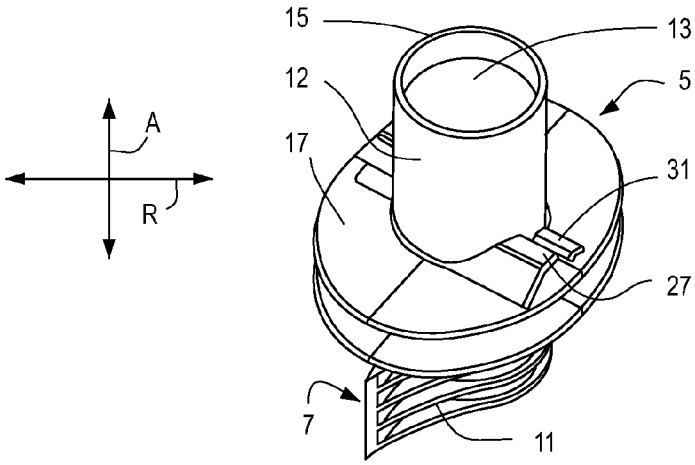
FIG. 10: a perspective top view of the base as in FIGS. 8 and 9.

The structure of the base 5 in an isolated position is visible in detail in the FIGS. 8 to 10. The support 7 is separated from the beak 12 by a central portion formed by at least two circular disks 17, 19.

The circular disk 17 facing away from the support 7 forms a purely radial abutment surface 21 facing away from the support. A pair of hooks 23 extends from the abutment surface 21, each hook having a hook base 25 and a hook end 27. The hook base 25 extends in an arm shaped manner in an angle of about 45° with respect to the radial abutment surface 21. The hook end 27 extends essentially exclusively in radial direction R parallel to the abutment surface 21. FIG. 10 shows that the circular disk 17 forms a ramp 31 at the abutment surface 21 slightly offset in circumferential direction relative to the hook end 27.

As evident from the FIGS. 9 and 10, the hooks 23 are disposed at opposite sides in circumferential direction at the abutment surface 21.

In FIGS. 3 to 7 the lid member 3 is represented in isolated position, the lid member having as main components a closure cap 41 and a cylindrical protective element 43 that supports the closure cap 41 in a pivotable or orientable manner. The cylindrical protective element 43 has at its axial end portions one opening respectively, namely one input opening 45 at the side of the container and, at the side facing away from the container, an output opening not shown in detail in the figures.

Figure 3:
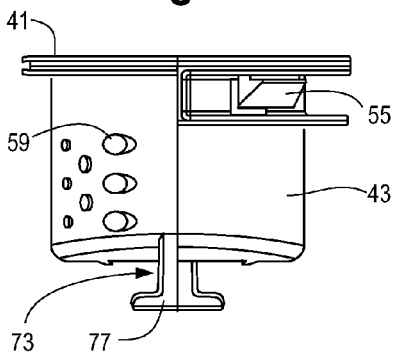
FIG. 3: a side view of the lid member of the closure element according to FIGS. 1 and 2.
Figure 4:
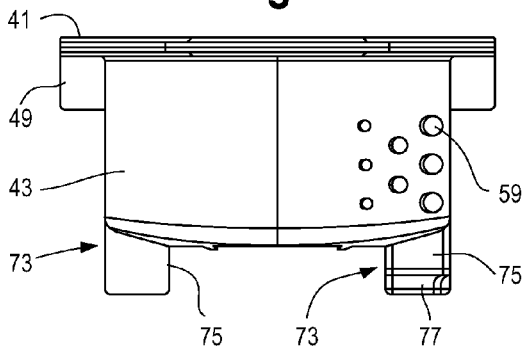
FIG. 4: a side view of the lid member according to FIG. 3, rotated by 90°.

FIGS. 3 and 4 show that the cylindrical protective element 43 leads in axial direction essentially with equal diameter up to a reinforced end rim 49 facing away from the container. In FIGS. 1 to 7 the closure cap 41 is represented in its closed position in which the closure cap 41 rests on the reinforced rim portion 49. As visible in FIG. 7 the closure cap 41 comprises an annular protrusion 51 protruding inwardly from the inside of the closure cap, the annular protrusion cooperating in a sealing manner with the opening of the beak 12 of the lid member 5 when the closure cap 41 is in a closed position. The closure cap 41 can have a ring-shaped outer protrusion 53 concentric with respect to the inner protrusion 51, the outer protrusion cooperating, in particular also in a sealing manner, with the output opening of the lid member 3 at the reinforcement rim 49 facing away from the container.

Figure 5:
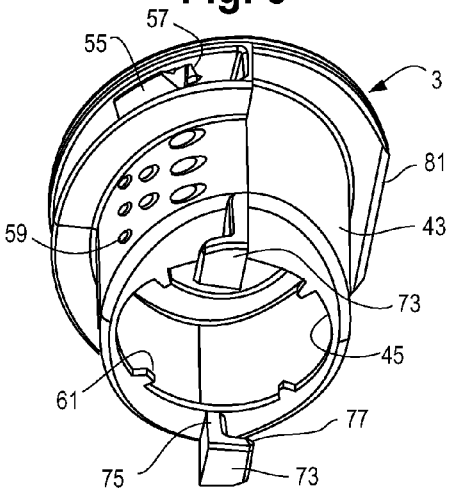
FIG. 5: a perspective bottom view of the lid member as in FIGS. 3 and 4.
Figure 6:
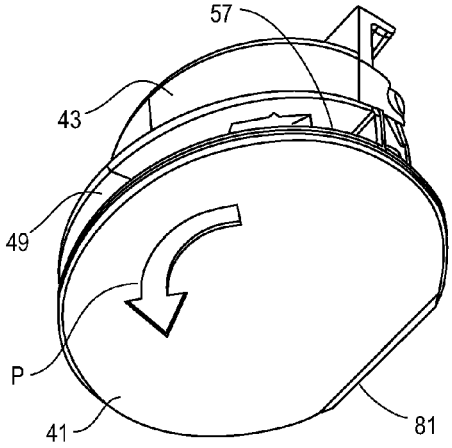
FIG. 6: a perspective top view of the lid member as in the FIGS. 3 to 5.
Figure 7:
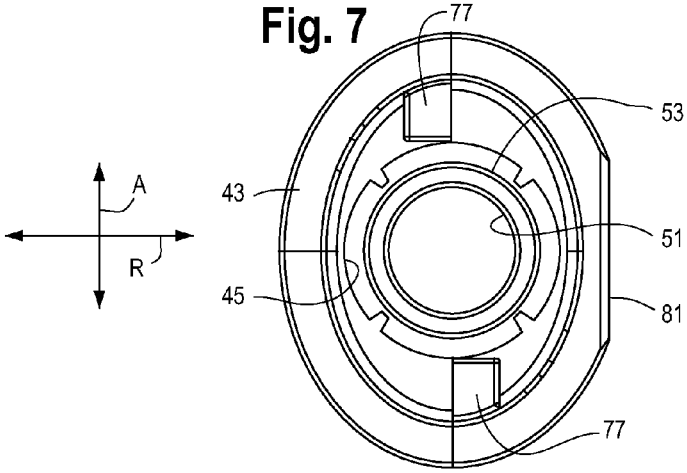
FIG. 7: a bottom view of the lid member as in FIGS. 3 to 6.

As evident from FIGS. 2, 3 and 5, two snapping hooks 55 are protruding from the closure cap 41 from its inner surface facing the protective element (in the closed position in axial direction A), the snapping hooks being able to cooperate in a snapping manner with the respective elongated holes 57 in order to hold tightly the closure cap 41 in its closed position at the protective element 43.

As shown in FIGS. 1 to 5, the protective element 43 can be provided with holes 59 of different size in order to enable venting of the lid member 3 and/or an improved grip of the lid member 3 for its rotation.

In a so-called transportation state or position, when the container is to be conveyed from the place of production to the end user and the integrity of the closure element is to be communicated to the end user prior to first usage in a clear and trustworthy manner, the lid member 3 is coupled to the base 5 via predetermined breaking points realised as connection ribs or slots 61 formed integrally with the base 5 and the lid member 2.

The predetermined breaking connection slots 61 are disposed in a group of four at the input opening 45 which can essentially extend radially inwards from the lid member 3 in order to merge into the outside of the beak 12. The coupling of the connection slot 61 with the beak 12 is indicated in FIG. 1.

In order to drink from the container via the beak 12 and to lead the beak 12 up to the mouth, the end user must first sever the predetermined breaking points 61 by applying exclusively rotational forces at the rotational part 3.

The lid member 3 furthermore has a pair of spring or detent hooks 73 respectively having a hook base 75 extending from the radial edge of the protective element 43 facing the container and a hook end 77 extending essentially in circumferential direction.

As evident from FIG. 2, the hooks 23, 73 are slightly spaced apart from each other in axial direction A in the transport state or position of the closure element 1, that is when the predetermined breaking points 61 are still intact, so that they do not interfere with each other.

Only upon rupture of the predetermined breaking points 61 the lid member 3 can be unmounted from the base 5 in order to release the beak for drinking. The lid member 3 can be mounted again and arrested on the base 5 by using the detent mechanism formed by the hooks 23, 73.

When installing the lid member 3 the beak 12 is introduced into the lid member via the input opening 45, wherein the hook end 77 comes into abutment with the abutment side of the circular disk 17 facing the lid member 3. In this way the axial position of the lid member 3 is determined with respect to the base 5.

Now the end user can fix the lid member 3 at the base 5 according to the usual practice by rotating the lid member 3 as it would be the case for common lid structures with a thread.

The rotation of the lid member 3 causes the hooks 23, 73 to come into a detent engagement with each other caused by protrusions and recesses at the hooks 23, 73 facing each other. Owing to the ramp 31 the lid-side hook 73 is pushed towards the base-side hook 23, which reinforces the detent function. In this way the container can be used for frequently being brought to the mouth without risk of contaminating the beak 12 through external influences. Rather the protective element 43 of the lid member 3 as well as the terminating cap 41 keep dirt and external influences away from the beak 12 and its opening 15.

For releasing the lid member 3 from the base 5 again, either the closure cap 41 must be hinged open by pivoting it via its film hinge articulation 81 integrally formed with the protective element 43, or the end user can disengage the detent mechanism, which serves for removably attaching the lid member 3 at the base 5, by means of overcoming the detent forces through rotation in direction of the arrow P and removal of the lid member.

The closure element according to the invention enables to obtain a simple structure for closing a bag-type container, wherein complicated threads for fixing the lid member 3 at the base 5 are dispensable.

The features disclosed in the above description, the figures and the claims can be relevant for the realisation of the invention in its different embodiments individually as well as in any combination.

What is claimed is:

1. A closure element (1) of a bag-type container from foil-type material, the closure element having a base (5) which comprises a spout (12) which defines a passage (13) and a lid member (3) mounted to the base (5) to clear and close the passage (13), wherein said lid member (3) comprises a cylindrical protective element (43), wherein said cylindrical protective element (43) has a larger diameter than said spout (12), and wherein the closure element (1) has a transport state in which the lid member (3) is attached to the base (5) via at least one predetermined breaking point (61), and an installation state in which, after separation of the predetermined breaking point attachment, the lid member (3) can rotate relative to the base (5) from an open position to a locked position in which the lid member (3) is removably held at the base (5) by a detent mechanism, wherein said detent mechanism is formed by at least two pairs of hooks (23, 73), wherein a first hook of each pair is fixed at the base (5) and a second hook of each pair is fixed at said cylindrical protective element (43) to engage with each other in a detent manner in the locked position.

2. The closure element according to claim 1, characterised in that the hooks (23, 73) have protrusions facing each other in the locked position and engaging in a recess of the respectively other hook (23, 73) in a snapping manner in the locked position.

3. The closure element according to claim 1, characterised in that the hooks (23, 73) are respectively disposed at the exterior of the base (5) and the cylindrical protective element (43).

4. The closure element according to claim 1, characterised in that the hooks (23, 73) are essentially oriented in rotational direction of the lid member (3).

5. The closure element according to claim 1, characterised in that a hook (73) at a cover side of the cylindrical protective element (43) can cooperate with an abutment surface (21) at the base side for determining the axial position of the lid member (3) relative to the base (5), wherein the hook (23) at the base side extends from the abutment surface (21) towards the lid member (3).

6. The closure element according to claim 5, characterised in that the abutment surface (21) is formed with a ramp (31) which is disposed relative to the hook at the base side in such a way that upon engagement of the hooks (23) the hook at the cover side of the cylindrical protective element (43) is pushed towards the hook at the base side.

7. The closure element according to claim 5, characterised in that the abutment surface (21) is formed as a large bearing surface with a particularly exclusively radial outer side surface that faces the lid member (3).

8. The closure element according to claim 1, characterised in that the at least one predetermined breaking point (61) is disposed at an inner edge of the lid member (3), which edge faces the container.

9. The closure element according to claim 1, characterised in that the at least one predetermined breaking point (61) is formed by a narrow connection protrusion extending from an inner side of the lid member (3) towards the base (5).

10. The closure element according to claim 9, characterised in that more than four connection slots are provided, disposed at equal distance from each other.

11. The closure element according to claim 1, characterised in that the base (5) has an external cylindrical wall section that is placed inside a cylindrical passage of the lid member (3) for guiding and/or positioning the lid member (3), for a rotational movement of the lid member (3).

12. The closure element according to claim 1, characterised in that the lid member (3) has a cylindrical internal passage in which an external cylindrical wall section of the base (5) is disposed and to which an opening (15) of the passage (13) of the base (5) is leading up, wherein the lid member (3) has a support and a closure cap (41) pivotably attached to the support, the closure cap closing the opening (15) in a sealing manner in a closed position.

13. The closure element according to claim 1, characterised in that the base (5) has a wedge-shaped reinforcement section (7), in particular with ribs (11), the wall section being connected to the reinforcement section, for welding the base (5) onto the container, wherein the reinforcement section (7) is surrounded by a section of the container and wherein the wall section is disposed outside the container.

14. The closure element according to claim 1, characterised in that the lid member (3), the base (5) and the at least one predetermined breaking point (61) are integrally made in one piece.

* * * * *